US007424917B2

(12) United States Patent
Martin

(10) Patent No.: US 7,424,917 B2
(45) Date of Patent: Sep. 16, 2008

(54) SUBSEA PRESSURE COMPENSATION SYSTEM

(75) Inventor: David W. Martin, Cranston, RI (US)

(73) Assignee: Varco I/P, Inc., Houston, TX (US)

( * ) Notice: Subject to any disclaimer, the term of this patent is extended or adjusted under 35 U.S.C. 154(b) by 477 days.

(21) Appl. No.: 11/087,399

(22) Filed: Mar. 23, 2005

(65) Prior Publication Data

US 2006/0231265 A1 Oct. 19, 2006

(51) Int. Cl.
*E21B 29/12* (2006.01)

(52) U.S. Cl. ..... 166/335; 166/373; 166/319

(58) Field of Classification Search ..... 166/357
See application file for complete search history.

(56) References Cited

U.S. PATENT DOCUMENTS

| | | | | |
|---|---|---|---|---|
| 3,163,985 | A | 1/1965 | Bouyoucos | |
| 3,205,969 | A | 9/1965 | Clark | |
| 3,436,914 | A | 4/1969 | Rosfelder | |
| 3,595,012 | A | 7/1971 | Beck | 60/1 |
| 3,653,635 | A | 4/1972 | Bates, Jr. et al | 254/172 |
| 3,677,001 | A | 7/1972 | Childers et al. | 60/51 |
| 3,912,227 | A | 10/1975 | Meeker et al. | 254/172 |
| 3,918,498 | A | 11/1975 | Schneider | 138/31 |
| 3,933,338 | A * | 1/1976 | Herd et al. | 251/63.6 |
| 3,987,708 | A | 10/1976 | Uhrich | 92/134 |
| 4,095,421 | A | 6/1978 | Silcox | 60/398 |
| RE30,115 | E * | 10/1979 | Herd et al. | 251/63.6 |
| 4,185,652 | A | 1/1980 | Zintz et al. | 137/81 |
| 4,205,594 | A | 6/1980 | Burke | 92/65 |
| 4,230,187 | A * | 10/1980 | Seto et al. | 166/336 |
| 4,294,284 | A | 10/1981 | Herd | 137/613 |
| 4,364,325 | A | 12/1982 | Bowditch | 114/331 |
| 4,367,800 | A * | 1/1983 | Arentsen | 173/127 |
| 4,649,704 | A | 3/1987 | Marsh | 60/415 |
| 4,777,800 | A | 10/1988 | Hay, II | 60/593 |
| 4,903,628 | A | 2/1990 | Lansford | 114/312 |
| 5,992,819 | A * | 11/1999 | Asskildt et al. | 251/63.6 |
| 6,059,539 | A * | 5/2000 | Nyilas et al. | 417/228 |
| 6,192,680 | B1 | 2/2001 | Brugman et al. | 60/398 |

(Continued)

FOREIGN PATENT DOCUMENTS

| | | |
|---|---|---|
| GB | 1.305.990 | 2/1973 |

(Continued)

OTHER PUBLICATIONS

Remote System Products. Hydraulic Compensator, Schilling Robotics, 3 pp., 2003.

(Continued)

*Primary Examiner*—Thomas A Beach
(74) *Attorney, Agent, or Firm*—Guy McClung

(57) ABSTRACT

Systems and method for operating subsea devices and pressure compensated reservoir systems useful therewith which in certain aspects, include a chamber with a piston therein acted on an exposed side by water, e.g. sea water, to provide operational hydraulic fluid for operating a subsea device, with a piston rod having an end in a separate chamber acted on by a fluid to compensate for a pressure differential between the pressure of the water on one piston side and the pressure of the operational hydraulic fluid on the other piston side.

11 Claims, 3 Drawing Sheets

U.S. PATENT DOCUMENTS

| | | | | |
|---|---|---|---|---|
| 6,202,753 | B1 | 3/2001 | Baugh | 166/364 |
| 6,223,825 | B1 | 5/2001 | Ingebrigsten et al. | 166/345 |
| 6,227,300 | B1 | 5/2001 | Cunningham et al. | 166/339 |
| 6,266,959 | B1 | 7/2001 | Markwart | 60/414 |
| 6,325,159 | B1 * | 12/2001 | Peterman et al. | 175/7 |
| 6,336,238 | B1 | 1/2002 | Tarlton | 15/3.5 |
| 6,386,290 | B1 | 5/2002 | Headworth | 166/346 |
| 6,394,131 | B1 | 5/2002 | Fross et al. | 137/614.05 |
| 6,408,947 | B1 | 6/2002 | Cunningham et al. | 166/339 |
| 6,418,970 | B1 | 7/2002 | Deul | 138/31 |
| 6,488,093 | B2 | 12/2002 | Moss | 166/339 |
| 6,659,180 | B2 | 12/2003 | Moss | 166/339 |
| 6,874,540 | B2 | 4/2005 | Lee | 138/31 |
| 7,108,006 | B2 * | 9/2006 | Armstrong | 137/14 |
| 7,137,450 | B2 * | 11/2006 | Johansen et al. | 166/316 |
| 7,156,183 | B2 * | 1/2007 | Williams | 166/386 |
| 7,159,662 | B2 * | 1/2007 | Johansen et al. | 166/374 |
| 7,240,737 | B2 * | 7/2007 | Tips | 166/373 |
| 7,249,634 | B2 * | 7/2007 | de Albuquerque Lima Goncalves et al. | 166/335 |
| 2004/0094306 | A1 | 5/2004 | Goode et al. | 166/339 |

FOREIGN PATENT DOCUMENTS

| | | | |
|---|---|---|---|
| WO | WO 02/02399 | A1 | 1/2002 |
| WO | WO 03/097446 | A1 | 11/2003 |

OTHER PUBLICATIONS

PCT/GB2006/050001; Written Opinion; 5 pp.: mailed May 4, 2006.
PCT/GB2006/050001; Int'l Search Report; 4 pp.: mailed May 4, 2006.

* cited by examiner

SUBSEA PRESSURE COMPENSATION SYSTEM

BACKGROUND OF THE INVENTION

1. Field of the Invention

The present invention is directed to underwater pressure compensation systems and, in certain particular aspects, to pressure compensation systems for closed-loop subsea hydraulic power systems.

2. Description of Related Art

The prior art discloses a wide variety of pressure compensation systems for underwater apparatuses and systems. In many underwater systems such as closed-loop subsea hydraulic power systems, it is desirable to maintain sufficient pressure within the system (an "overpressure") to prevent the ingress of sea water into the system. In certain closed-loop systems, the fluid used in the system is re-circulated; but when subsea systems are at a substantial depth below the water surface designs that would withstand the pressure at such depths require inordinate and excessively strong enclosures. To overcome this problem, "pressure-compensated" systems have been developed in which a subsea equipment housing or enclosure need only withstand a pressure differential between the external pressure exerted on the enclosure by the water and an internal pressure which is maintained within the enclosure. In certain applications hydraulic fluid within an enclosure is pressurized by a spring that applies a force to a piston.

FIG. 1 illustrates schematically one typical prior art method for providing pressure compensation for hydraulic fluid F in an hydraulic fluid reservoir R which is in fluid communication with an apparatus A which is operated by the selective and controlled application of the hydraulic fluid F. A hollow body B has a piston P movably and sealingly mounted therein. The pressure of sea water S admitted through an opening O in the body B pushes against an outer face T of the piston P, pushing the piston P inwardly. Thus, the pressure of the sea water is applied to both the interior and to the exterior of the reservoir effecting the desired pressure compensation. A spring G biased between the piston face F and an inner wall W of the body B applies a force to the piston P, thereby providing additional pressure to the fluid F. Such systems work well if the volume of fluid F in the reservoir R is relatively constant with a maximum change on overall volume of 2-3 gallons or if the total overall volume is small, e.g. 2-3 gallons.

In the use of certain prior art subsea actuators, the actuator is not only remote from the hydraulic supply which is at the surface, but there can also be a substantial elevation difference. For example, with a pressure such as 3000 psi at the surface, the actual pressure at the actuator will be increased substantially beyond that by the weight or hydrostatic head of the fluid. The actual operating pressure of the accumulator is increased since the opposite side of the piston must discharge the hydraulic fluid either against the static head of a return line or against ambient seawater pressure, where water compatible hydraulic fluid is used. Seawater at a depth of 6700 feet has a static head of about 3000 psi. Accordingly, for an effective operating pressure of 3000 psi, the actual pressure at the actuator, and therefore at the accumulator is actually 6000 psi. A gas filled accumulator pressurized to 3000 psi at the surface would have the gas compressed to one half the volume at the operating depth and only half the hydraulic fluid would be available, while alternately the accumulator would have to be twice as large and, for an accumulator of the type which uses a compressed spring, this would require that the spring be compressed with an input force equivalent to 6000 psi initially. This becomes an exceedingly large and cumbersome mechanical spring system.

U.S. Pat. No. 3,987,708 discloses a system which uses a conventional gas charged accumulator with the high gas pressure providing the motive force for the accumulator and is depth compensated by means of a small hydraulic piston having one side open to the ambient, or sea pressure to provide depth compensation. This avoids the problem of the increased compression of the accumulator gas, but still requires that the accumulator be precharged to full gas pressure at the surface. It also contains extremely high pressure gas which must be sealed over a long period of time.

U.S. Pat. No. 4,777,800 discloses an hydraulic system accumulator designed to discharge its hydraulic capacity at a preselected pressure level, and designed to operate at a preselected depth, for instance, the known depth of a subsea wellhead. Charging of the accumulator at the surface is not required, the charge being developed as the accumulator is lowered to the desired depth. A piston assembly has a large diameter piston effectively exposed to the ambient pressure of the seawater and a small diameter piston effectively exposed to the hydraulic system pressure. The opposing side of each piston is exposed to contained low pressure gas. The differential area of the pistons causes the accumulator to buildup a predictable unbalanced force against the hydraulic fluid as a function of depth to which the accumulator is lowered.

There has long been a need, recognized by the present inventor, for an effective pressure compensation system for underwater systems and apparatuses. There has long been a need, recognized by the present inventor, for such systems for subsea hydraulic systems and for such hydraulic systems that are closed-loop and require relatively large amounts of hydraulic fluid to flow from a reservoir to operate equipment, and then be recirculated back to the reservoir.

SUMMARY OF THE PRESENT INVENTION

The present invention, in certain aspects, discloses a pressure compensation system for subsea apparatus which has one or more hydraulic power units used in a closed-loop hydraulic fluid system. In certain aspects, such subsea apparatus employs one or more hydraulic fluid reservoirs and/or accumulators which releasably hold operational amounts of hydraulic fluid at a pressure slightly greater than the pressure of water exterior to the reservoir for selectively operating subsea equipment and systems, e.g. BOP's, coiled tubing units, and subsea wellhead connectors. The reservoir and/or accumulator(s) can require a substantial amount (e.g. 50, 100, 500 gallons or more) of hydraulic fluid which can entail the flow of this substantial amount of fluid from a reservoir to the accumulator(s).

The reservoir is initially charged at a pressure slightly higher than the pressure of the water to be encountered at depth and the reservoir is pressure compensated so that at depth it is not damaged or destroyed. This pressure compensation is accomplished according to certain aspects of the present invention with a piston that is movably disposed in a main piston housing which includes the reservoir for the system's operational hydraulic fluid. A piston rod has one end connected to the piston within the housing and another end projecting through the housing. An outer face of the piston is exposed to the pressure of the water (e.g. sea water) which pushes on the exterior of the piston. The end of the piston rod projecting from the housing moves sealingly in and out of a rod chamber. A fluid reservoir is in fluid communication with the interior of the rod chamber and applies fluid (gas, hydraulic fluid) under pressure to the piston rod sufficient to adjust the pressure of the operational hydraulic fluid within the reservoir of the operational hydraulic fluid. The area of the interior surface of the piston is less than the area of the exterior surface of the piston (the area on which the sea water pressure is applied) in an amount equal to the area of the piston rod. Thus, the applied pressure of the gas on the piston rod end need only apply a pressure equal to the sea water pressure to perfectly balance the system. Reducing the applied pressure below the sea water pressure creates an overpressure of the operational hydraulic fluid. For example, with a piston having an area of about 855 square inches (diameter 33") and a piston rod with an area of 14 square inches, a 15 gallon nitrogen system can apply nitrogen at 1840 psi in the rod chamber to the piston rod end to compensate (with an overpressure of 16 psi) for a sea water pressure on the piston's exterior of 2900 psi.

It is, therefore, an object of at least certain preferred embodiments of the present invention to provide:

New, useful, unique, efficient, non-obvious pressure compensation systems for closed-loop hydraulic fluid reservoirs (in one aspect, subsea), and such pressure-compensated reservoirs;

Such pressure-compensated reservoirs which can effectively handle significantly large flows of fluid into and out of the reservoir;

Such systems which can effectively provide a desired internal overpressure for such subsea reservoirs; and Such systems in which certain parts not exposed to high differential pressure can be made of relatively low-strength and/or relatively light weight materials (e.g. chamber enclosures made of aluminum, structural steel sheet, or plastic and pistons made of the same materials) with a minimum of parts requiring high-strength materials.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of certain embodiments of the invention may be had by references to the embodiments which are shown in the drawings which form a part of this specification.

DESCRIPTION OF EMBODIMENTS PREFERRED AT THE TIME OF FILING FOR THIS PATENT

Figure 1:
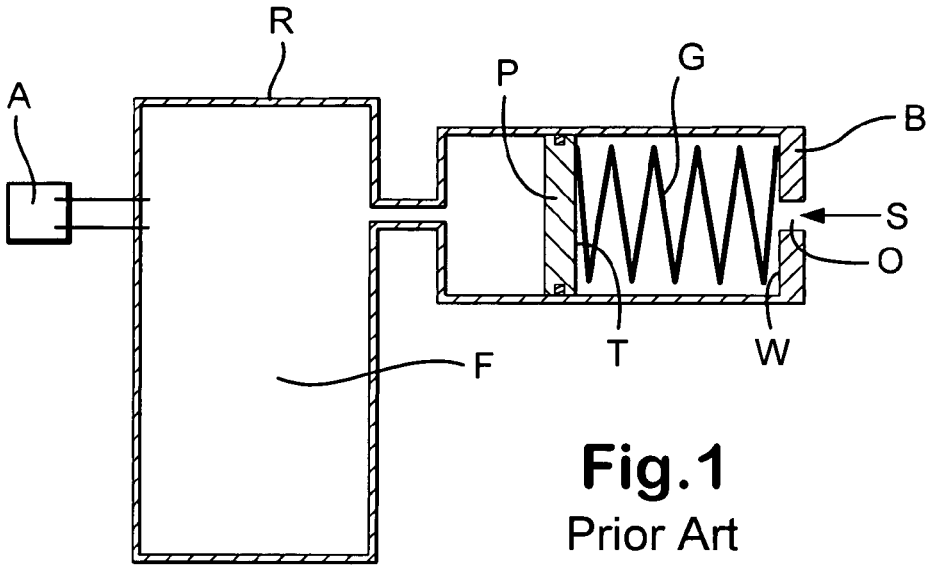
Fig.1 Prior Art
FIG. 1 is a schematic view of a prior art pressure compensated reservoir.
Figure 2:
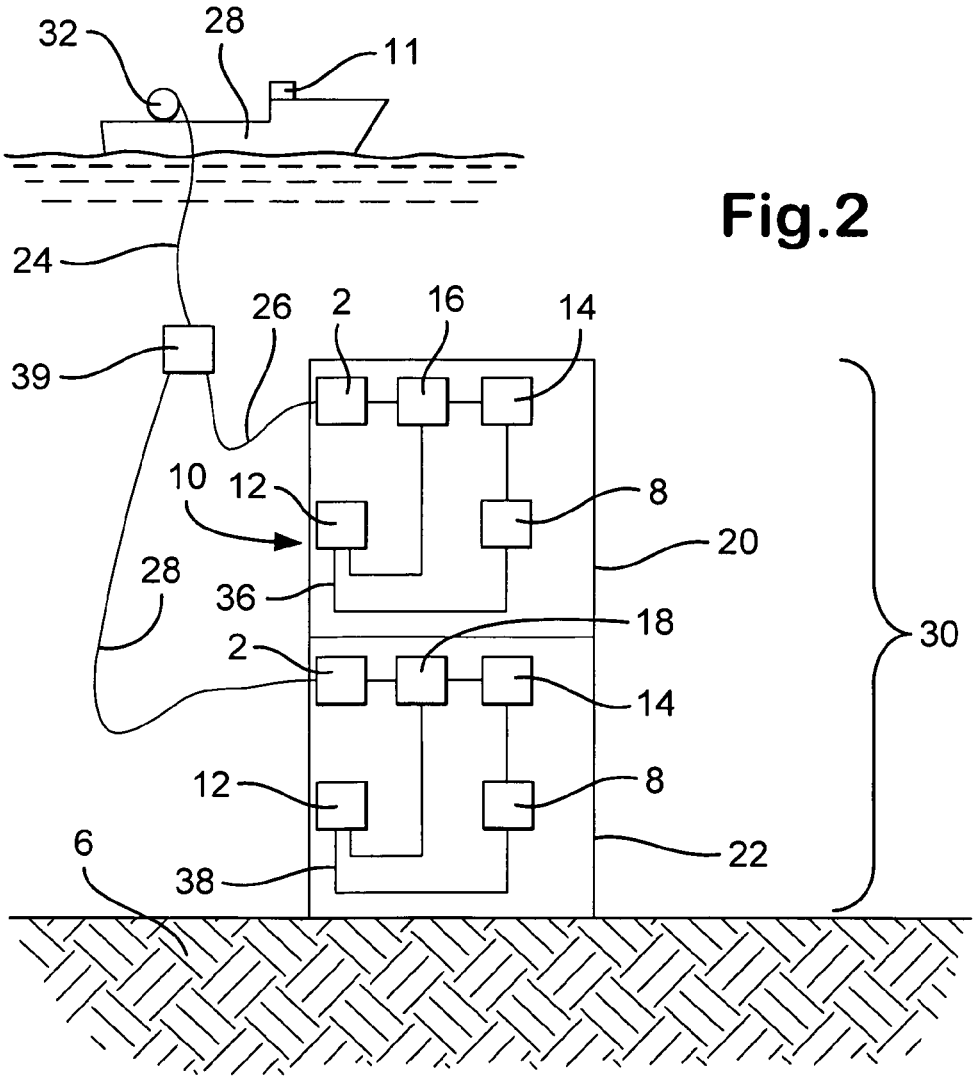
FIG. 2 is a schematic view of a system according to the present invention.

FIG. 2 shows a system 10 according to the present invention with a coiled tubing module 20 and a blowout preventer module 22, each including a pressure-compensated reservoir system 12 in fluid communication with one or a bank of accumulators 14, each of which is in fluid communication with an hydraulic power unit (16 or 18) of a subsea module 30 on a seafloor 6 in a closed-loop system. The hydraulic power unit 16 selectively operates a subsea coiled tubing system of the module 20 and the hydraulic power unit 18 selectively operates a subsea blowout preventer ("BOP") system of the module 22. Fluid flows from the units 16, 18 to the accumulator(s) 14, to apparatus 8 (e.g., BOP; coil tubing apparatus) to be operated by the hydraulic power fluid, and then back to the reservoir system 12 in lines 36, 38 respectively. The system 12 has a reservoir charged at the surface to balance the pressure to be encountered at a depth at which the system will be used.

A power/communications umbilical 24 from a reel 32 on a floating vessel 28 supplies power to the subsea module 30 via a junction box 39 and umbilicals 26, 28. The pressure of the sea water 4 is applied to a movable piston in the pressure-compensated reservoir system 12. Control systems 2 control the modules' functions. A control system 11 remote from the underwater structures is in communication with the control systems 2.

Figure 3:
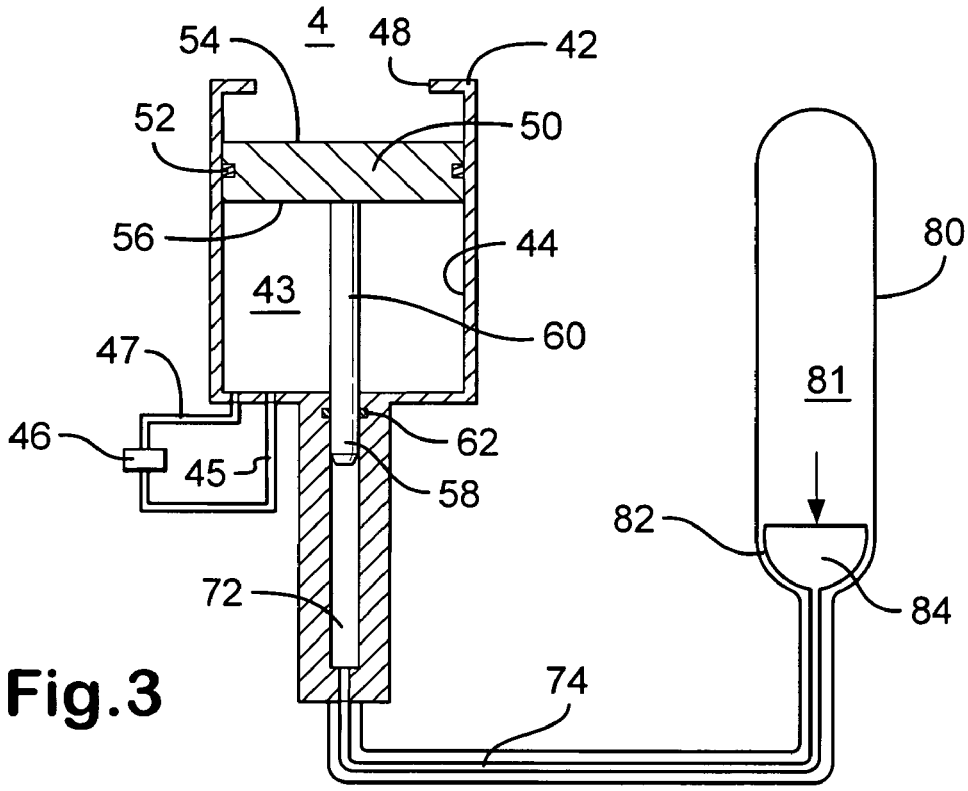
FIG. 3 is a schematic view of a system according to the present invention.

FIG. 3 shows one embodiment 40 according to the present invention of a pressure compensated reservoir system, e.g. useful as the system 12 of FIG. 2. A hollow body 42 contains an amount of hydraulic fluid 43 in an interior chamber 44. Via a flow channel 45, hydraulic fluid under pressure is supplied for operation of an apparatus 46 (e.g. a motor, accumulator(s), BOP control system, or any of the apparatuses 8, FIG. 2). This fluid flows back to the chamber 44 via a channel 47 in a closed loop system.

An outer opening 48 of the body 42 is closed off by a piston 50 which is sealingly mounted with a seal 52 for movement within the chamber 44. Sea water 4 exterior to the body 42 exerts pressure on an outer surface 54 of the piston 50.

A piston rod 60 is sealingly mounted with a seal 52 for movement within the chamber 44.

A piston rod 60 is connected at one end to an interior portion 56 of the piston 50. Another end 58 of the piston rod 60 is sealingly movable within an interior 72 of a piston rod chamber 70. A seal 62 seals a piston-rod/piston-rod-chamber interface.

Figure 7B:
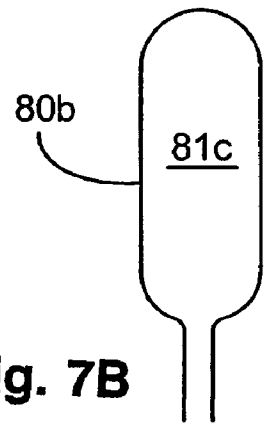
FIG. 7B is a schematic view of part of a system according to the present invention.
Figure 7A:
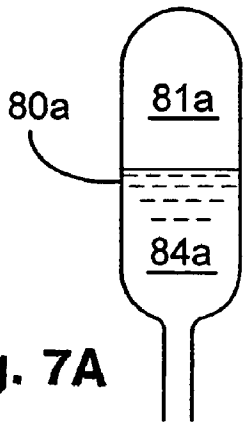
FIG. 7A is a schematic view of part of a system according to the present invention.

Gas 81 under pressure in a vessel 80 provides pressure against a compressible bladder 82 which contains hydraulic fluid 84 which provides pressure against the piston rod end 58 to counter the pressure of the sea water 4 against the outer surface 54 of the piston 50. Thus, with a chamber initially charged to a pressure equal to the sea water pressure, the pressure in the chamber 44 is always greater than the pressure of the sea water 4; e.g., in one aspect between 10 to 20 psi greater and, in one particular aspect, 15 psi greater. In one aspect the bladder 82 is deleted and the gas itself provides pressure against the piston rod end 58 (see, e.g. a vessel 80*b*, FIG. 7A, like the vessel 80, FIG. 4, with gas 81*c* therein that acts on the piston rod end 58). Alternatively, the bladder is deleted and gas 81*a*, FIG. 7A expands and contracts above hydraulic fluid 84*a* in a vessel 80*a*, like the vessel 80, FIG. 4. The hydraulic fluid 84*a* acts on the piston rod end 58. In certain embodiments, a system as in FIG. 3 (and other systems according to the present invention) can handle sea water pressures up to 6000 psi.

Figure 5:
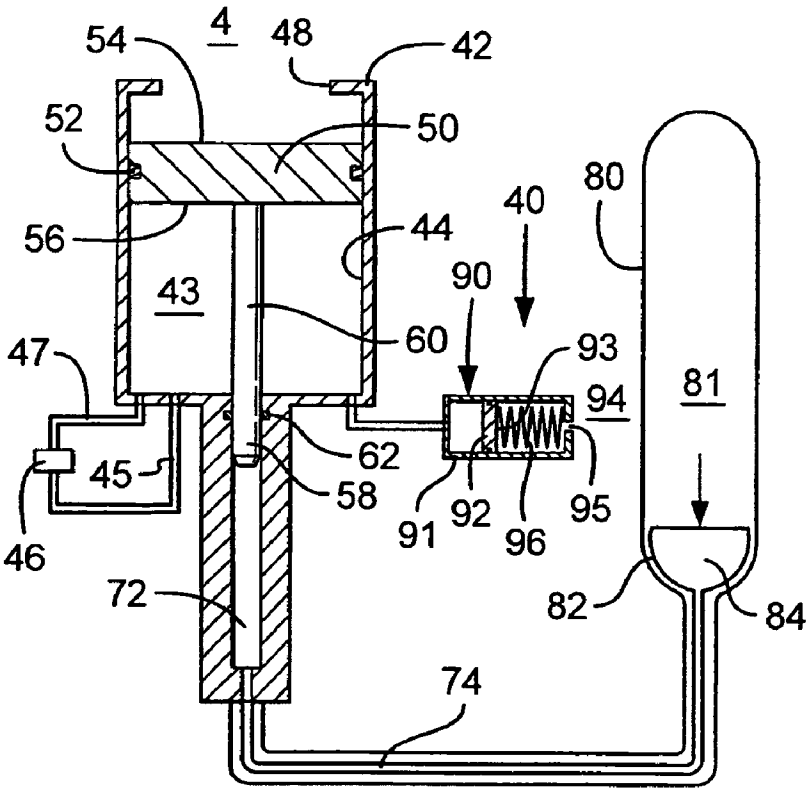
FIG. 5 is a schematic view of a system according to the present invention.

Optionally, as shown in FIG. 5, a secondary pressure compensator 90 provides pressure on the hydraulic fluid 43 in the chamber 44; e.g. for movement of the pressure-compensated reservoir 40 from a water surface to a location beneath the water surface so that, as the pressure-compensated reservoir is moved down in a body of water, a minimum desired pressure (e.g. 10 to 20 psi) is applied to the hydraulic fluid 43 to provide a desired overpressure so that sea water cannot flow into the reservoir 40 at any depth prior to removing fluid from the reservoir. The secondary pressure compensator 90 can be like any suitable known pressure compensator system or apparatus or system according to the present invention, including, but not limited to, a well-known system with an enclosure 91 in which is movably mounted a piston 92 with a surface 93 exposed to the sea water 4 through an opening 95 through the enclosure 91. Once the piston 92 strokes out (contacts the interior of enclosure 91—left end as viewed in FIG. 5) the piston 50 can be moved by the pressurized gas 84. Like parts in FIGS. 3 and 5 have like identifying numerals.

Figure 4:
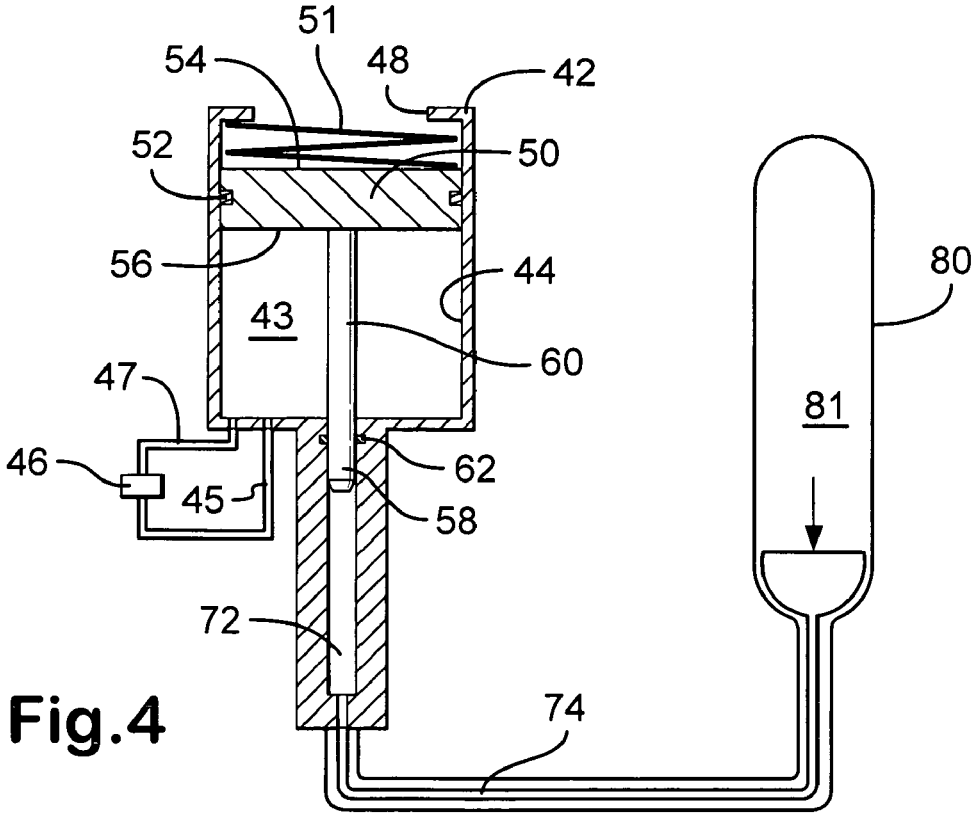
FIG. 4 is a schematic view of a system according to the present invention.

FIG. 4 shows a system 40 (as disclosed in FIG. 3) with an optional spring 51 which provides an initial force to overpressure the operational hydraulic fluid prior to reaching an operating depth. Once at depth, desired overpressurization is provided by a system according to the present invention. After removing a certain amount of fluid (e.g. 0.5 gal) from the reservoir, the spring reaches its free length and no longer exerts a force.

Figure 6:
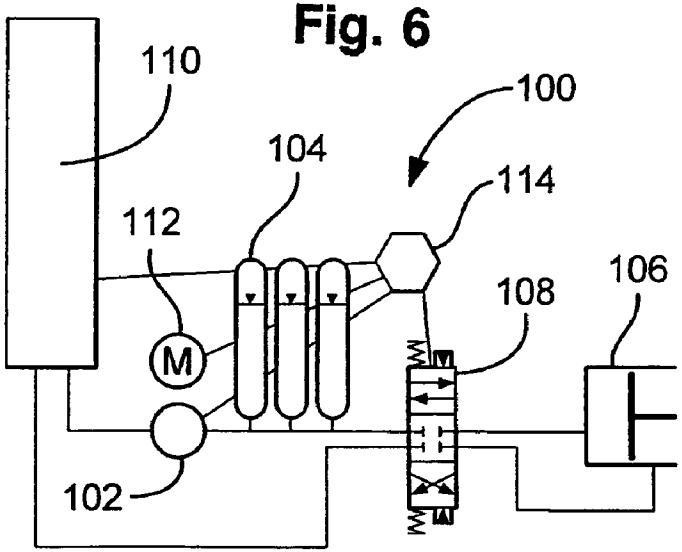
FIG. 6 is a schematic view of a system according to the present invention.

FIG. 6 shows a system 100 according to the present invention with a pressure-compensated reservoir 110 according to the present invention (like any disclosed herein according to the present invention). Like parts in FIGS. 3 and 4 are indicated by like identifying numerals. A pump 102 driven by a motor 112 (e.g. electric, pneumatic, or hydraulic) selectively and controllably pumps hydraulic fluid from the reservoir system 110 (as any described herein according to the present invention) to fluid accumulators 104 from which the fluid is supplied, on demand, to operate subsea equipment, e.g. a subsea BOP system 106. A valve (or valves) 108 control the flow of fluid to and from the BOP system 106. As shown the system 100 is a closed loop system with all fluid pumped from the reservoir system 110 flowing back from the BOP system 106 to the reservoir system 110 for further re-circulation and use. A control system 114 controls the items 102, 110, 112, and 108. Instead of the BOP system 106, any other device or apparatus to be operated can be used in the system 100.

The present invention, therefore, in at least some, but not necessarily all embodiments, provides a pressure compensated reservoir with a body with an interior chamber, a first opening in the body, and a second opening in the body with an amount of operational hydraulic fluid therein; a piston with an outer surface and an inner surface movably and sealingly mounted in the interior chamber, the piston closing off the first opening and preventing hydraulic fluid from exiting through the first opening from the interior chamber, the operational hydraulic fluid exerting pressure against the piston's inner surface; a piston rod with a first end and a second end, the first end connected to the interior surface of the piston, the second end projecting through the second opening; a piston rod chamber having an interior, the second end of the piston rod projecting into and movable in the piston rod chamber; at least one operating channel through the body for providing hydraulic fluid from the reservoir for operating an hydraulically-powered apparatus; a fluid system for providing fluid (gas or hydraulic fluid) under pressure to the second piston rod end within the piston rod chamber; a channel through the piston rod chamber, the fluid system in fluid communication with the interior of the piston rod chamber via the channel; the outer surface of the piston greater than the inner surface of the piston and the outer surface positioned for pressure thereagainst by fluid exterior to the body so that a pressure differential exists due to the pressure exerted by the operational hydraulic fluid and the fluid exterior to the body; and the pressure of the fluid of the fluid system compensating for the pressure differential. Such a pressure compensated reservoir may have one or some (in any possible combination) of the following: wherein the fluid provided by the fluid system is gas; wherein the fluid provided by the fluid system is hydraulic fluid; the fluid system including a housing with gas under pressure therein, a bladder system with a compressible bladder apparatus positioned so that the a portion thereof in the housing is acted on by the gas in the housing, hydraulic fluid in the bladder apparatus, the bladder apparatus in fluid communication via a flow line with the piston rod chamber so that hydraulic fluid in the bladder system is applied to the second end of the piston rod; wherein the amount of operational hydraulic fluid in the interior chamber is at least 100 gallons or is about 120 gallons; a spring with a portion thereof in contact with the outer surface of the piston, the spring biased against the piston and urging the piston away from the first opening; an auxiliary pressure compensator with an auxiliary enclosure in fluid communication with the interior chamber; the auxiliary compensator for applying a minimum desired pressure to the operational hydraulic fluid in the interior chamber; and/or wherein the auxiliary compensator's auxiliary enclosure has an opening in fluid communication with the exterior of the auxiliary enclosure and with the first opening, and an auxiliary piston movably mounted within the auxiliary enclosure, the auxiliary piston exposed to fluid exterior to the auxiliary enclosure so that pressure of fluid exterior to the auxiliary enclosure applies pressure via the auxiliary piston on the operational hydraulic fluid.

The present invention, therefore, in at least some, but not necessarily all embodiments, provides a pressure compensated reservoir with a body with an interior chamber, a first opening in the body, and a second opening in the body; an amount of operational hydraulic fluid in the interior chamber under pressure; a piston movably and sealingly mounted in the interior chamber, the piston closing off the first opening and preventing hydraulic fluid from exiting through the first opening from the interior chamber, the piston having an outer surface and an inner surface, the operational hydraulic fluid exerting pressure against the piston's inner surface; a piston rod with a first end and a second end, the first end connected to the interior surface of the piston, the second end projecting through the second opening; a piston rod chamber having an interior, the second end of the piston rod projecting into and sealingly movable in the piston rod chamber; at least one operating channel through the body for providing hydraulic fluid from the reservoir for operating an hydraulically-powered apparatus; a fluid system for providing fluid under pressure to the second piston rod end within the piston rod chamber; a channel through the piston rod chamber, the fluid system in fluid communication with the interior of the piston rod chamber via the channel; the outer surface of the piston greater than the inner surface of the piston and the outer surface positioned for pressure thereagainst by fluid exterior to the body so that a pressure differential exists due to the pressure exerted by the operational hydraulic fluid and the fluid exterior to the body; the pressure of the fluid of the fluid system compensating for the pressure differential; wherein the fluid provided by the fluid system is hydraulic fluid; the fluid system comprising a housing with gas under pressure therein; a bladder system with a compressible bladder apparatus positioned so that the a portion thereof in the housing is acted on by the gas in the housing; hydraulic fluid in the bladder apparatus; the bladder apparatus in fluid communication via a flow line with the piston rod chamber so that hydraulic fluid in the bladder system is applied to the second end of the piston rod; and wherein the amount of operational hydraulic fluid in the interior chamber is at least 100 gallons.

The present invention, therefore, in at least some, but not necessarily all embodiments, provides a subsea system including a pump system for providing operational power fluid to a subsea device for operating the subsea device; a compensated pressure reservoir system for receiving operational power fluid from the subsea device and for providing operational power fluid to the pump system; the compensated pressure reservoir system as any disclosed herein according to the present invention. Such a system may have one or some (in any possible combination) of the following: the pump system including pump apparatus, motor apparatus for driving the pump apparatus; accumulator apparatus in fluid communication with the pump apparatus for receiving operational hydraulic fluid from the pump apparatus and for maintaining said fluid under pressure for later use; valve apparatus for selectively placing the pump apparatus in fluid communication with the subsea device; a control system for controlling the pump system, and the subsea device; umbilical apparatus for providing power to the control system and communication between the control system and control apparatus remote from the control system; and/or wherein the subsea device is a blowout preventer or a subsea coil tubing module.

The present invention, therefore, in at least some, but not necessarily all embodiments, provides a method for compensating for water pressure on a subsea device, the method including placing the subsea device in fluid communication with an interior chamber of a compensated pressure reservoir system, the compensated pressure reservoir system as any disclosed herein according to the present invention.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A subsea system comprising a pump system for providing operational power fluid to a subsea device for operating the subsea device, a compensated pressure reservoir system for receiving operational power fluid from the subsea device and for providing operational power fluid to the pump system, the compensated pressure reservoir system comprising a body with an interior chamber, a first opening in the body, and a second opening in the body, an amount of operational hydraulic fluid in the interior chamber under a first pressure, a piston movably and sealingly mounted in the interior chamber, the piston closing off the first opening and preventing hydraulic fluid from exiting through the first opening from the interior chamber, the piston having an outer surface and an inner surface, the operational hydraulic fluid applying the first pressure against the piston's inner surface, fluid exterior to the pressure compensated reservoir able to apply pressure to the outer surface of the piston, a piston rod with a first end and a second end, the first end connected to the interior surface of the piston, the second end projecting through the second opening, a piston rod chamber having an interior, the second end of the piston rod projecting into and movable in the piston rod chamber, at least one operating channel through the body for providing hydraulic fluid from the reservoir for operating an hydraulically-powered apparatus, a fluid system for providing fluid under pressure to the second piston rod end within the piston rod chamber, a channel through the piston rod chamber, the fluid system in fluid communication with the interior of the piston rod chamber via the channel, the outer surface of the piston greater than the inner surface of the piston and the outer surface positioned for pressure thereagainst by the fluid exterior to the body creating a pressure differential between the first pressure of the operational hydraulic fluid and pressure applied by the fluid exterior to the body, and the pressure of the fluid of the fluid system compensating for the pressure differential.

2. The subsea system of claim 1 further comprising the pump system comprising pump apparatus, motor apparatus for driving the pump apparatus.

3. The subsea system of claim 1 further comprising accumulator apparatus in fluid communication with the pump apparatus for receiving operational hydraulic fluid from the pump apparatus and for maintaining said fluid under pressure for later use.

4. The subsea system of claim 1 further comprising valve apparatus for selectively placing the pump apparatus in fluid communication with the subsea device.

5. The subsea system of claim 1 further comprising a control system for controlling the pump system and the subsea device.

6. The subsea system of claim 1 further comprising umbilical apparatus for providing power to the control system and communication between the control system and control apparatus remote from the control system.

7. The subsea system of claim 1 further comprising the pump system comprising pump apparatus, and motor apparatus for driving the pump apparatus, valve apparatus for selectively placing the pump apparatus in fluid communication with the subsea device, a control system for controlling the pump system, the valve apparatus, and the subsea device, and umbilical apparatus for providing power to the control system and communication between the control system and control apparatus remote from the control system.

8. The subsea system of claim 1 further comprising the subsea device, and the subsea device is a blowout preventer.

9. The subsea system of claim 1 further comprising the subsea device, and the subsea device is a subsea coil tubing apparatus.

10. The subsea system of claim 1 wherein the compensated pressure reservoir system further comprises the fluid system including a housing with gas under pressure therein, a bladder system with a compressible bladder apparatus positioned so that the a portion thereof in the housing is acted on by the gas in the housing, hydraulic fluid in the bladder apparatus, the bladder apparatus in fluid communication via a flow line with the piston rod chamber so that hydraulic fluid in the bladder system is applied to the second end of the piston rod, and wherein the amount of operational hydraulic fluid in the interior chamber is at least 100 gallons.

11. A method for compensating for water pressure on a subsea device, the method comprising placing the subsea device in fluid communication with an interior chamber of a compensated pressure reservoir system, the compensated pressure reservoir system comprising a body with an interior chamber, a first opening in the body, and a second opening in the body, an amount of operational hydraulic fluid in the interior chamber under a first pressure, a piston movably and sealingly mounted in the interior chamber, the piston closing off the first opening and preventing hydraulic fluid from exiting through the first opening from the interior chamber, the piston having an outer surface and an inner surface, the operational hydraulic fluid applying the first pressure against the piston's inner surface, fluid exterior to the pressure compensated reservoir able to apply pressure to the outer surface of the piston, a piston rod with a first end and a second end, the first end connected to the interior surface of the piston, the second end projecting through the second opening, a piston rod chamber having an interior, the second end of the piston rod projecting into and movable in the piston rod chamber, at least one operating channel through the body for providing hydraulic fluid from the reservoir for operating an hydraulically-powered apparatus, a fluid system for providing fluid under pressure to the second piston rod end within the piston rod chamber, a channel through the piston rod chamber, the fluid system in fluid communication with the interior of the piston rod chamber via the channel, the outer surface of the piston greater than the inner surface of the piston and the outer surface positioned for pressure thereagainst by the fluid exterior to the body creating a pressure differential between the first pressure of the operational hydraulic fluid and pressure applied by the fluid exterior to the body, and the pressure of the fluid of the fluid system compensating for the pressure differential.

* * * * *